US011766129B2

(12) United States Patent
Katz

(10) Patent No.: US 11,766,129 B2
(45) Date of Patent: Sep. 26, 2023

(54) FOOTREST DEVICE

(71) Applicant: Renae Katz, Levittown, NY (US)

(72) Inventor: Renae Katz, Levittown, NY (US)

( * ) Notice: Subject to any disclaimer, the term of this patent is extended or adjusted under 35 U.S.C. 154(b) by 0 days.

(21) Appl. No.: 17/526,078

(22) Filed: Nov. 15, 2021

(65) Prior Publication Data

US 2022/0160133 A1 May 26, 2022

Related U.S. Application Data

(60) Provisional application No. 63/116,323, filed on Nov. 20, 2020.

(51) Int. Cl.
*A47C 16/02* (2006.01)

(52) U.S. Cl.
CPC ..... *A47C 16/025* (2013.01)

(58) Field of Classification Search
CPC ..... A63B 21/4034; A45B 2023/0012; A45B 2200/1063; A47C 16/025
USPC ..... 297/423.39
See application file for complete search history.

(56) References Cited

U.S. PATENT DOCUMENTS 2,720,249 A * 10/1955 Peterson ..... A47C 9/10 108/150
4,086,921 A * 5/1978 Gonzales ..... A61H 23/02 601/22
4,870,779 A * 10/1989 Johnson ..... A01M 29/24 116/22 A
5,161,561 A * 11/1992 Jamieson ..... A45B 23/00 248/156
6,487,977 B1 * 12/2002 Williams ..... E04H 12/2223 108/150
6,705,240 B2 * 3/2004 Block ..... A47B 37/04 108/150
6,802,265 B1 * 10/2004 Dodson ..... A47B 9/08 108/1
9,554,630 B1 * 1/2017 Patel ..... A45B 25/18
11,019,912 B2 * 6/2021 Saunders ..... A45C 3/10
2008/0092936 A1 * 4/2008 Carabillo ..... A45B 3/04 135/16
2017/0215643 A1 * 8/2017 Beach ..... A47J 39/02
2018/0020794 A1 * 1/2018 Rao ..... A45C 5/02 320/114
2018/0117384 A1 * 5/2018 Endelman ..... A63B 21/025

* cited by examiner

*Primary Examiner* — Sarah B McPartlin
(74) *Attorney, Agent, or Firm* — Brennan, Manna & Diamond, LLC

(57) ABSTRACT

The present invention relates generally to the field of footrests. More specifically, the present invention relates to a footrest device designed to screw into a ground surface. The footrest is comprised of a foot board that has an anti-skid texture, that allows a user to rest his or her feet in an inclined position. The footrest is further comprised of a conical structure attached to a ball bearing at a top end, wherein the conical structure is screwed into the ground surface to secure the footrest. Further, a user can place the footrest in a variety of locations with various heights depending on their preference.

17 Claims, 8 Drawing Sheets

FOOTREST DEVICE

CROSS-REFERENCE TO RELATED APPLICATION

The present application claims priority to, and the benefit of, U.S. Provisional Application No. 63/116,323, which was filed on Nov. 20, 2020, and is incorporated herein by reference in its entirety.

FIELD OF THE INVENTION

The present invention relates generally to the field of footrests. More specifically, the present invention relates to a footrest device designed to screw into a ground surface. The footrest is comprised of a foot board that has an anti-skid texture that allows a user to rest his or her feet in an inclined position. The footrest is further comprised of a conical structure attached to a ball bearing at a top end, wherein the conical structure is screwed into the ground surface to secure the footrest. Further, users can place the footrest in a variety of locations with various heights, depending on their preference. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, campers and beachgoers may carry numerous items to campsites and beaches such as beach chairs, beach umbrellas, mats, music systems and more. Many differing types of beach chairs exist in the art, including canopy beach chairs, folding chairs, backpack beach chairs and more. Conventional beach chairs may allow users to rest their bodies, however said chairs typically lack a place to rest their feet. Because conventional beach chairs lack footrests, individuals must place their feet on the dirt or sand where their feet become dirty, hot and uncomfortable. Further, if the beach or dirt surface contains thorns or other sharp objects, which are often found at campsites and beaches, such as broken glass, an individual's feet may be cut and become infected.

To avoid discomfort and possible injury to their feet, individuals may bring additional items to a campsite or beach, including a lounge chair that includes a foot rest. However, these chairs are designed for homes, and as a result are large and difficult to transport and carry to the beach. In addition, dirt, sand and rain at a campsite or beach may soil or damage a lounge chair that is designed for interior use.

Alternatively, people may carry a foot mat to the beach, as they are much lighter and more portable. However, foot mats lay flat on the ground and cannot be inclined, thus requiring users to keep their feet in the same plane as the ground, which may be uncomfortable. Also, foot mats are not capable of height adjustment, and as a result the feet of children may not reach the foot mat, and adults cannot elevate their feet.

Therefore, there exists a long-felt need in the art for an improved footrest for campsites and beaches that is lightweight and portable. There also exists a long-felt need in the art for an improved footrest for campsites and beaches that can be inclined and elevated to keeps a user's feet clean and safe. Further, there exists a long-felt need in the art for an improved footrest for campsites and beaches that is usable on rough, outdoor surfaces and made of cleanable and durable materials suitable for outdoor environments. Finally, there is a long-felt need in the art for an improved footrest for campsites and beaches that allows users to enjoy a campsite or beach while keeping their feet clean, safe, and comfortable.

SUMMARY OF THE INVENTION

The following presents a simplified summary in order to provide a basic understanding of some aspects of the disclosed innovation. This summary is not an extensive overview. Rather its purpose is to present some general concepts in a simplified form as a prelude to the more detailed description that is presented later.

The subject matter disclosed and claimed herein, in one embodiment thereof, comprises an improved footrest device. More specifically, the footrest device is comprised of a generally rectangular or square foot board and a conical-shaped structure. The foot board has an upper surface and a lower surface, wherein the upper surface has an anti-skid gripping texture, and the lower surface has a ball bearing at the center. The conical-shaped structure has a protruding connector at one end that is configured to attach to the ball bearing, a tapered thread along the conical structure extending to the opposite end, and a corkscrew tip at the opposite end configured to be screwed into the sand, ground or other outdoor surface. The conical structure can also be screwed into the ground at various angles and depths, such that when the foot board is attached it will be inclined and elevated to suit the needs of the user The components of the footrest device are detachable to allow the device to be easily stored and transported as per the needs and requirements of a user. The device is further made from one or more materials such as but not limited to: wood, plastic, metal, rubber, silicone, etc., allowing the device to be lightweight, durable in outdoor settings and easy to clean.

In this manner, the novel footrest for campsites and beaches of the present invention accomplishes all of the forgoing objectives and provides a lightweight and portable footrest that can be inclined and elevated. Further, the device can be easily cleaned, and is made of durable materials suitable for outdoor settings. Finally, the device keeps a user's feet clean and safe from dangerous ground objects.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
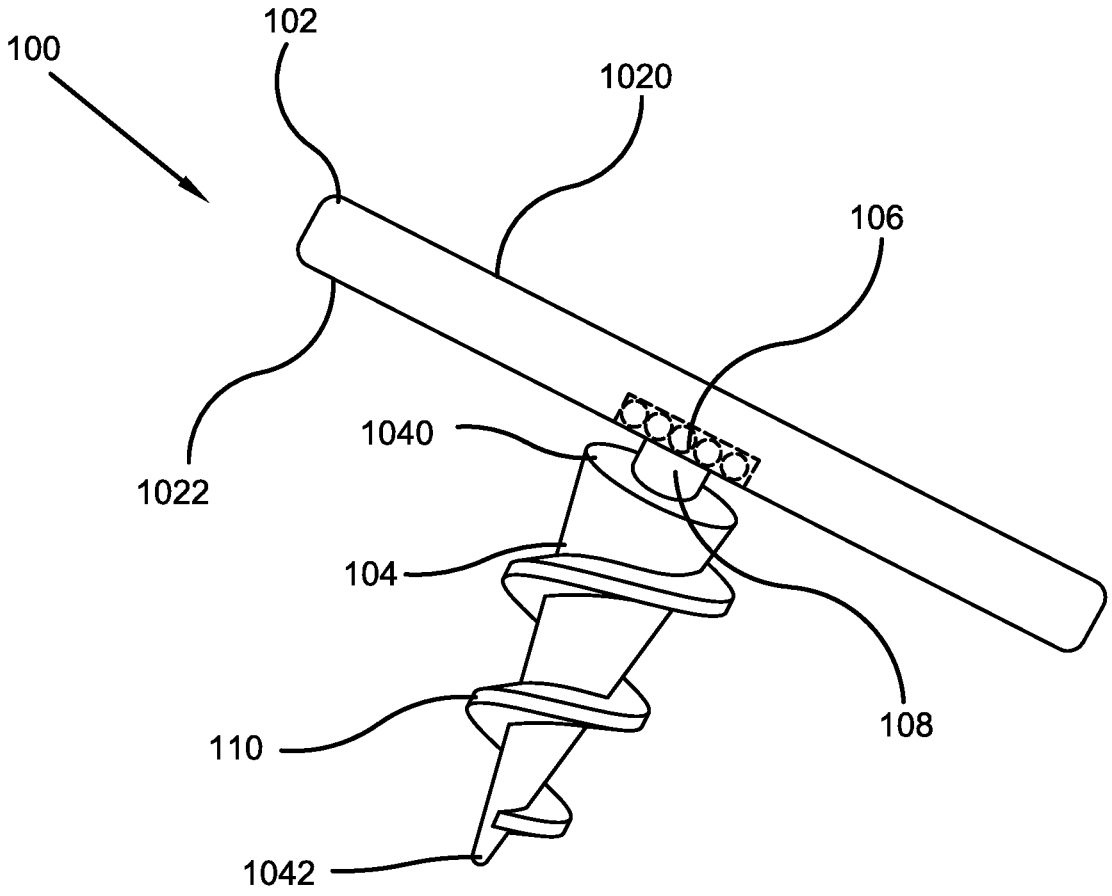
FIG. 1 illustrates a side perspective view of one potential embodiment of a footrest device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an improved footrest for campsites and beaches that is lightweight and portable, and that can be inclined and elevated to keeps a user's feet clean and safe. Further, there exists a long-felt need in the art for an improved footrest for campsites and beaches that is usable on rough, outdoor surfaces and made of cleanable and durable materials suitable for outdoor environments. Finally, there is a long-felt need in the art for an improved footrest for campsites and beaches that allows users to enjoy a campsite or beach while keeping their feet clean, safe and comfortable.

The present invention, in one exemplary embodiment, comprises a novel footrest device. The device is comprised of a foot board having an upper surface with an anti-skid, gripping texture, and a lower surface with a ball bearing that attaches to a conical-shaped structure. The conical shaped structure further includes a connector at one end for attaching to the ball bearing, a tapered thread along the conical structure extending to the opposite end and a cork screw tip at the opposite end. The conical structure can further be screwed into sand, dirt or other outdoor ground surfaces.

Referring initially to the drawings, FIG. 1 illustrates a side perspective view of one potential embodiment of a footrest device 100 of the present invention in accordance with the disclosed architecture. The device 100 is a lightweight footrest that can be used on a supporting surface such as dirt, sand or gravel, or other ground surfaces found at locations such as campsites and beaches. The footrest 100 creates a sturdy location to rest a user's feet, and prevents a user from having to place his or her feet onto the surrounding ground surface. The footrest 100 includes a generally rectangular or square foot board 102 mounted on a conical-shaped structure 104. The foot board 102 is removably-attached to the conical-shaped structure 104, thereby allowing a user to easily detach the components, pack them in a bag and carry them when not in use.

The rectangular or square foot board 102 has an upper surface 1020 and a lower surface 1022. The upper surface 1020 has an anti-skid, gripping texture, and users place their feet on the upper surface 1020. The lower surface 1022 has an attached ball bearing 106 that connects to a connector or a protruding structure 108 of the conical shaped structure 104 allowing the foot board 102 to be secured and locked to the conical-shaped structure 104, to form a stable unit. The ball bearing 106 is permanently attached to the lower surface 1022 of the foot board 102. The connector 108 is dimensioned to fit detachably to the ball bearing 106. The conical-shaped structure 104 has a top section 1040 forming a base, and a bottom end 1042 having a conical tip designed to be screwed into sand, dirt, or other like ground surfaces. The connector 108 is a protruding structure permanently connected to the top section 1040 of the conical-shaped structure 104 and is configured to attach to the ball bearing 106.

The footrest 100 is specifically designed for sand, dirt, and other like ground surfaces such that the corkscrew end 110 of the conical shaped structure 104 can be screwed into the ground surface, thereby allowing the footrest 100 to be secured into said surface. Unlike a foot stool that may have a number of supporting legs that can be difficult to position on rough surfaces, the footrest 100 is secured to the ground at one point, removing any difficulties resulting from multiple supporting legs. The conically-shaped structure 104 further includes a tapered thread terminating at the cork screw end 110 that allows the conical shaped structure 104 to screw into sand, dirt, gravel or other like ground surfaces. As a function of the angle and depth in which the conical-shaped structure 104 is screwed into the ground, the foot board 102 can be inclined and elevated as per the preferences of the user.

The foot board 102 can be made from one or more combinations of wood, plastic, metal, rubber, silicone or other materials of the like. The upper surface 1020 has an anti-skid gripping texture, thus enhancing overall stability. In the present embodiment, a lightweight, non-slipping and cooling material such as a terry cloth or cotton can comprise or cover the foot board, 102 providing additional comfort for the user. The conical-shaped structure 104 has a preferred length of approximately 6-9 inches, and the foot board 102 has preferred dimensions ranging from approximately 25 to 30 inches wide and 40 to 45 inches long.

Figure 2B:
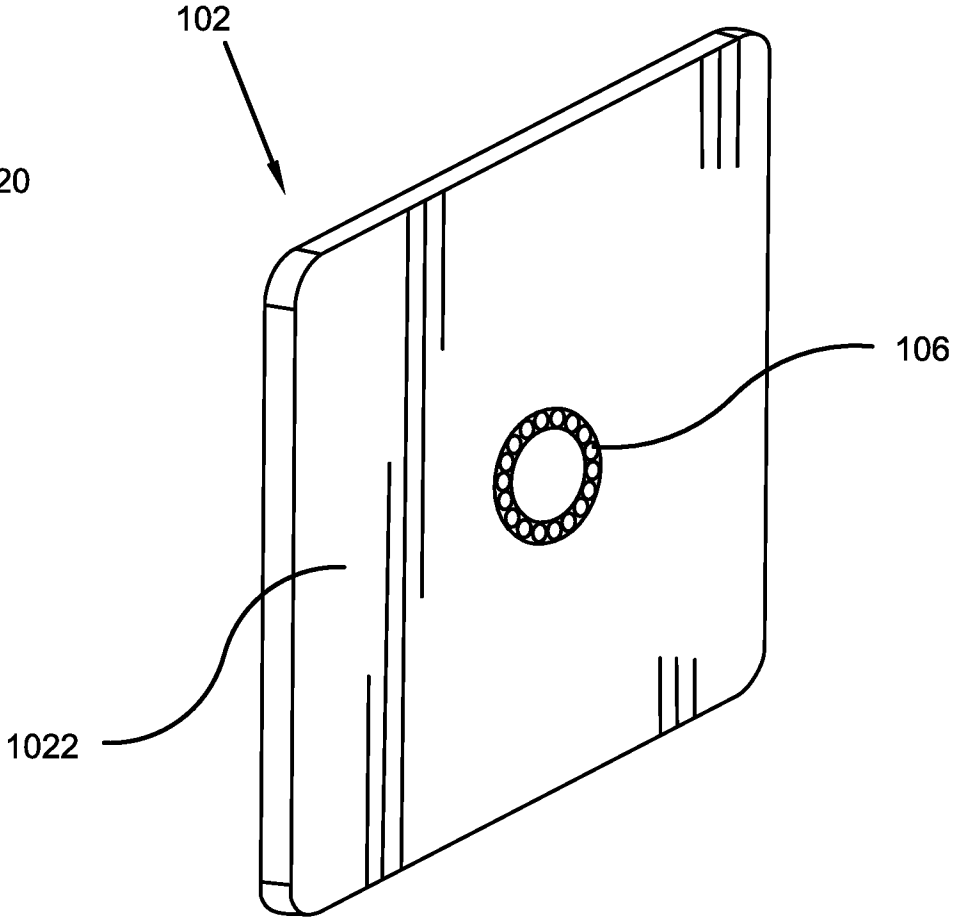
FIG. 2B illustrates a rear perspective view of one potential embodiment of a foot board that comprises one potential embodiment of a footrest device of the present invention in accordance with the disclosed architecture.
Figure 2A:
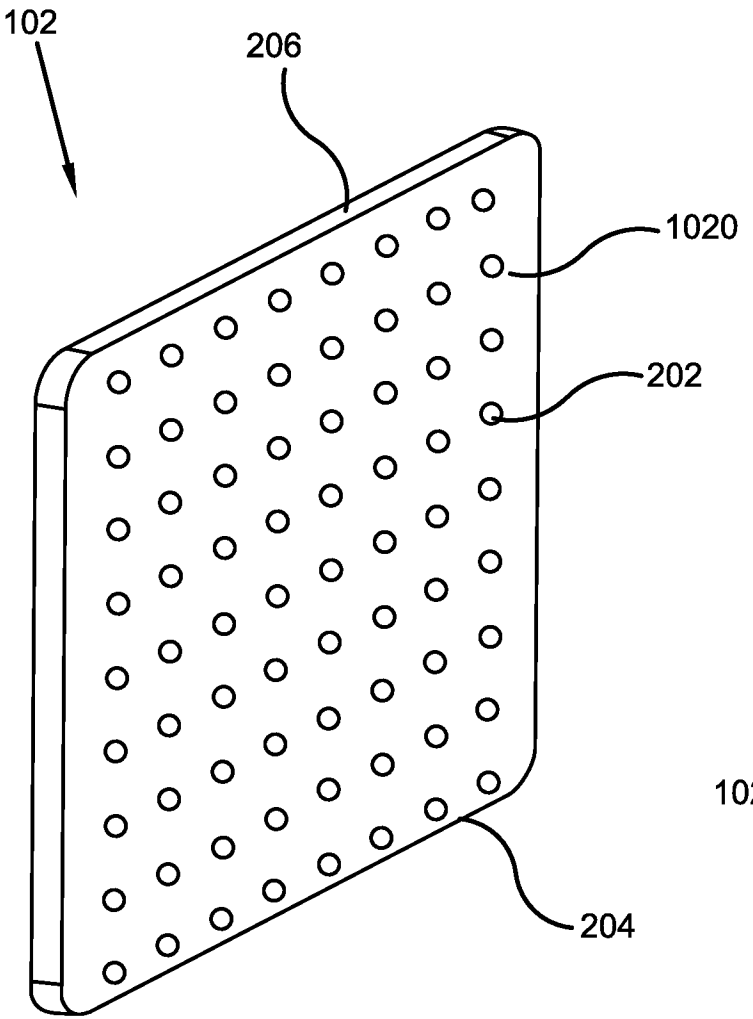
FIG. 2A illustrates a front perspective view of one potential embodiment of a foot board that comprises one potential embodiment of a footrest device of the present invention in accordance with the disclosed architecture.

FIG. 2A illustrates a front perspective view of one potential embodiment of a foot board 102 that comprises one potential embodiment of a footrest device 100 of the present invention in accordance with the disclosed architecture.

While using the footrest 100, a user places his or her feet on the upper surface 1020 of the foot board 102. The upper surface 1020 has an anti-skid, gripping texture 202. The foot board 102 has a front edge 204 and an opposite edge 206. During use, the front edge 204 is nearer to the user, and the ground and the opposite edge 206 is farther from the user and higher than the front edge 204, thus providing an inclined angle to the foot board 102 with respect to the ground surface. Users further place their heels near the front edge 204 and their toes near the opposite edge 206.

FIG. 2B illustrates a rear perspective view of one potential embodiment of a foot board 102 that comprises one potential embodiment of a footrest device 100 of the present invention in accordance with the disclosed architecture. The lower surface 1022 of the foot board 102 has a ball bearing 106 permanently attached near the center of the lower surface 1022. The ball bearing 106 is used for receiving a connecting member 108 and a conical-shaped structure 104 to allow the foot board 102 to be detachably-connected to the conical-shaped structure 104. It should be understood that any other fastener device or groove can also be used in place of the ball bearing 106 for securing to the conical-shaped structure to the lower surface 1022 of the foot board 102.

Figure 3:
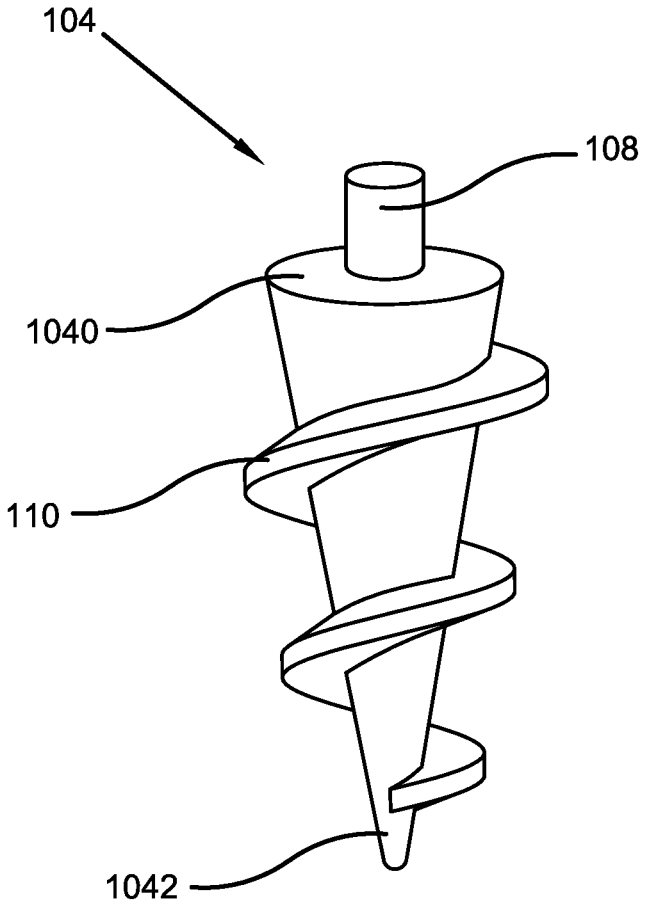
FIG. 3 illustrates a perspective view of one potential embodiment of a conical-shaped structure that comprises one potential embodiment of a footrest device of the present invention in accordance with the disclosed architecture.

FIG. 3 illustrates a perspective view of one potential embodiment of a conical-shaped structure 104 that comprises one potential embodiment of a footrest device 100 of the present invention in accordance with the disclosed architecture. The conical-shaped structure 104 is specifically designed to screw into a ground surface using the corkscrew end 110, wherein a user need only apply little force on the conical-shaped structure 104 to push the pointed bottom end 1042 into the ground surface, enabling the screwing action of the corkscrew end 110 that further penetrates the ground as the user rotates the conical-shaped structure 104. The user also can choose the inclination and the depth to which the conical-shaped structure 104 is screwed into the ground surface. Once the conical-shaped structure 104 is securely positioned in ground surface, the foot board 102 can be connected using the protruding connecting member 108. The top surface 1040 further supports the foot board 102 which will be inclined and elevated as a function of the inclination and depth to which the conical-shaped structure 104 is screwed into the dirt or sand.

Figure 4:
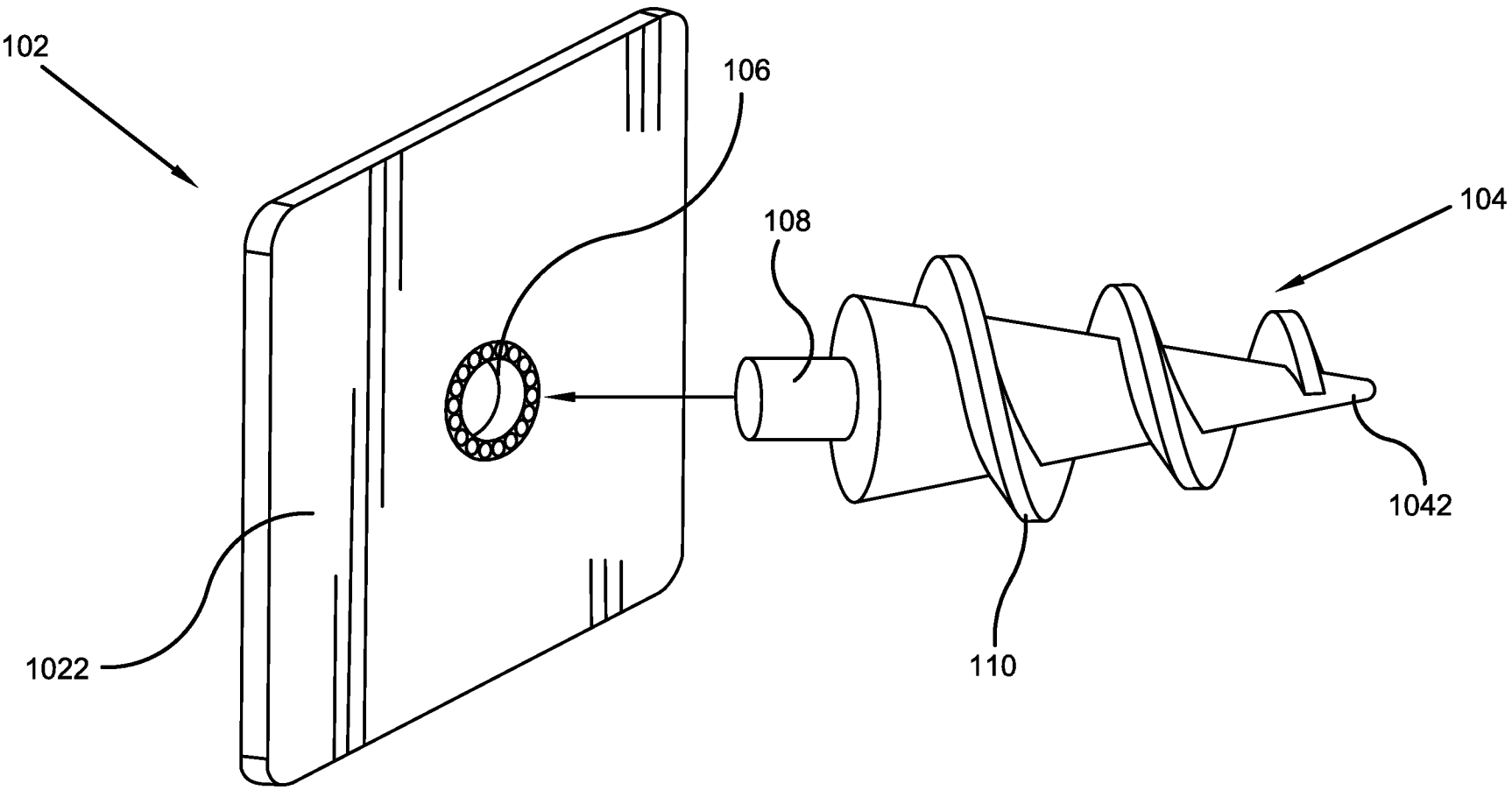
FIG. 4 illustrates a perspective of one potential embodiment of a conical-shaped structure that is attached to one potential embodiment of a foot board of the footrest device of the present invention in accordance with the disclosed architecture.

FIG. 4 illustrates a perspective of one potential embodiment of a conical-shaped structure 104 that is attached to one potential embodiment of a foot board of the footrest device 100 of the present invention in accordance with the disclosed architecture. To assemble the device 100, the protruding connector 108 of the conical structure 108 is attached to the ball bearing 106 of the lower surface 1022 of the foot board 102. The connector 108 is dimensioned to fit into the ball bearing, thereby allowing the board 102 to securely attach to the conical-shaped structure 104 in a desired orientation as per the preferences of a user. Once the conical-shaped structure 104 is attached to the ball bearing 106, the bottom tip 1042 and the corkscrew end 110 may be screwed into a surface at the desired inclination and to the desired depth.

Figure 5:
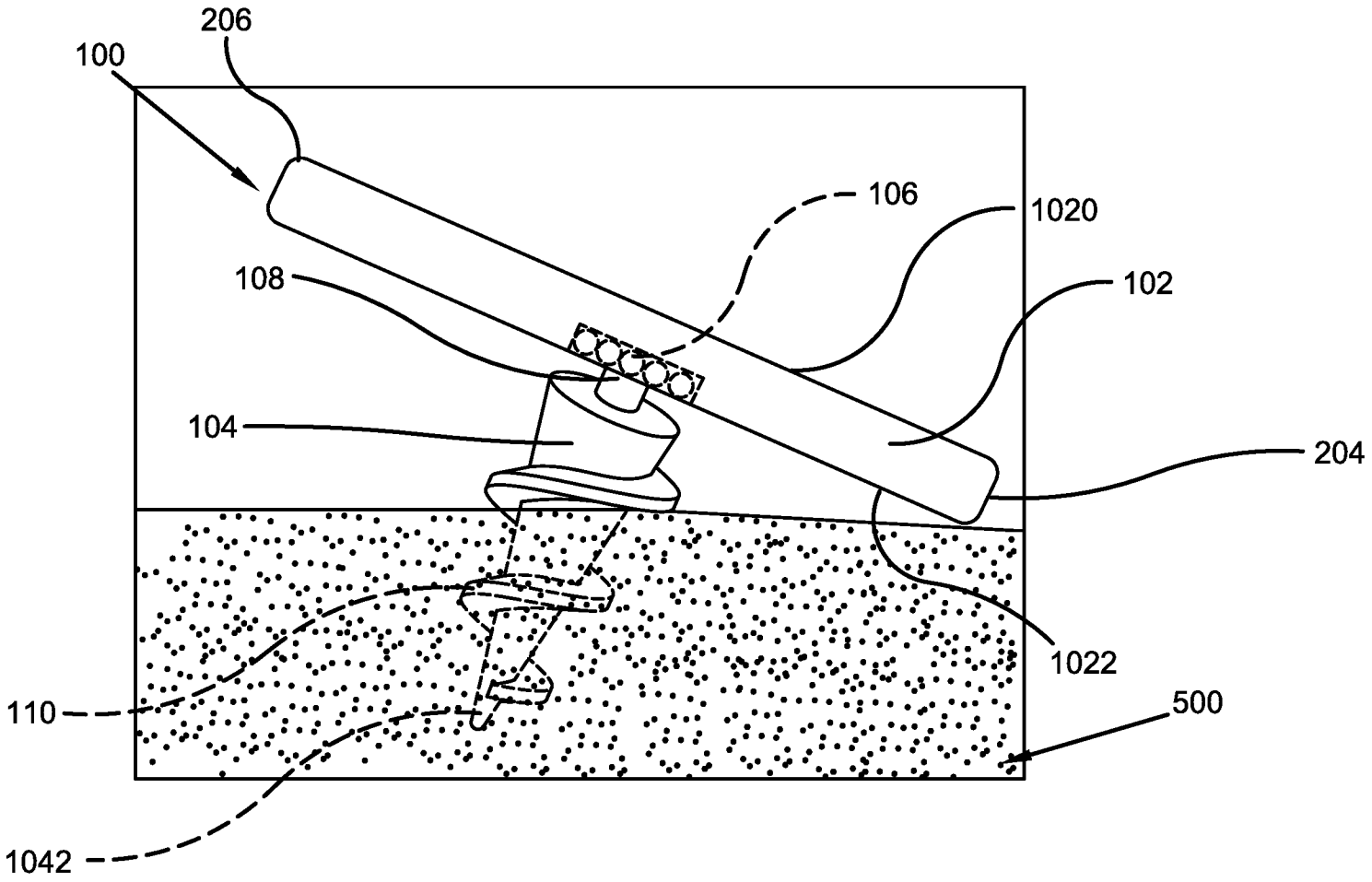
FIG. 5 illustrates a perspective view showing one potential embodiment of the footrest device of the present invention screwed into a ground surface in accordance with the disclosed architecture.

FIG. 5 illustrates a perspective view showing one potential embodiment of the footrest device 100 of the present invention screwed into a ground surface 500 in accordance with the disclosed architecture. The bottom tip 1042 of the conical-shaped structure 104 is pushed into a ground surface 500. Using the corkscrew end 110 and the proper orientation, the conical-shaped structure 104 can be secured into the ground such that the front edge 204 of the foot board 102 is nearer to the ground 500 than the opposite edge 206. The conical structure 104 can then be attached to the foot board 102 at the lower surface 1022 by connecting the protruding connector 108 to the ball bearing 106. To adjust the height or elevation of the footrest 100, the depth in which the conical structure 104 penetrates into the sand 500 can be adjusted as per the preferences of a user. During use, a lightweight and cooling fabric such as terry cloth or cotton can comprise or be used to cover the foot board 102, especially the top surface 1020.

Figure 6:
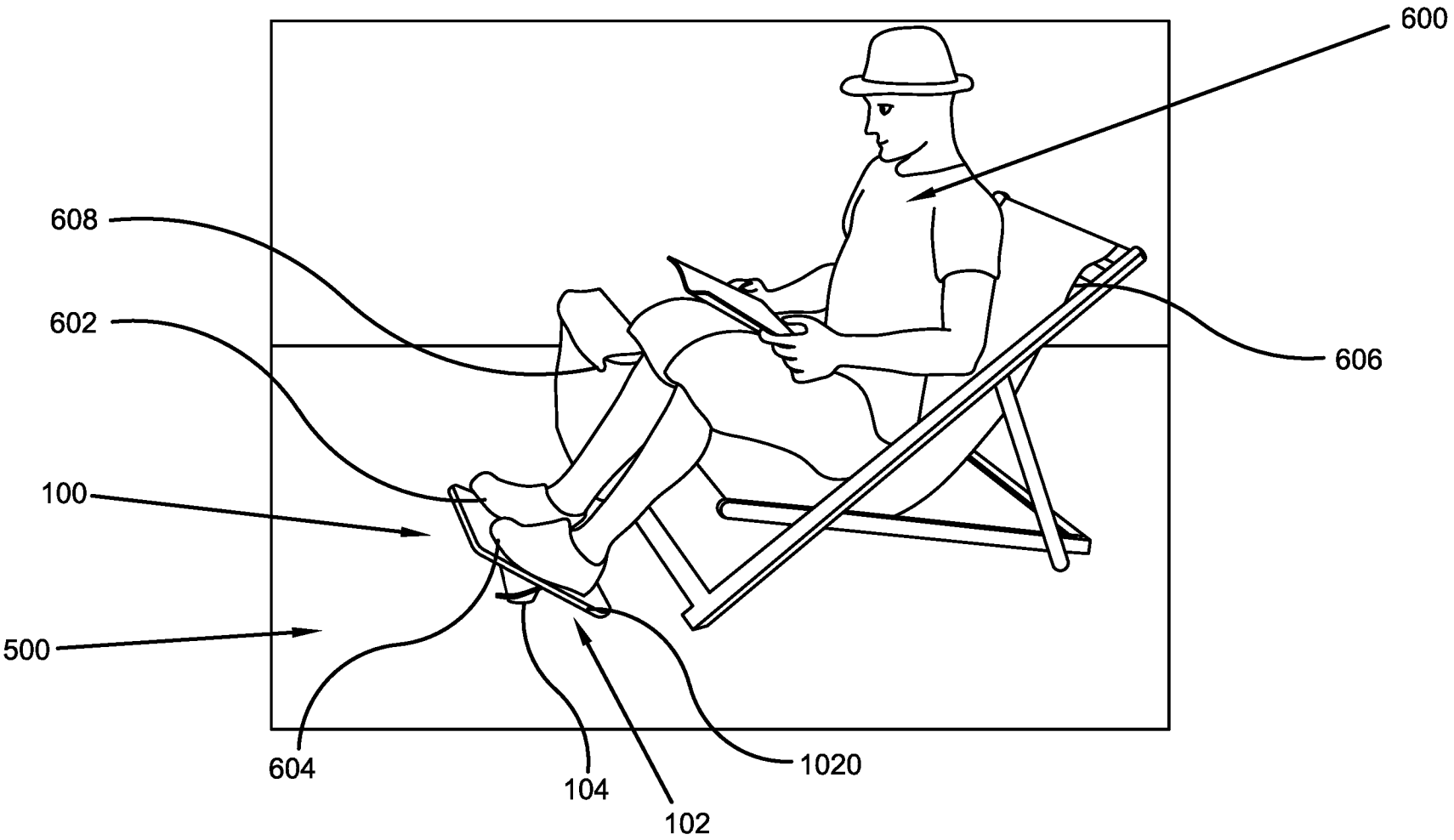
FIG. 6 illustrates a perspective view showing one potential embodiment of a footrest device of the present invention screwed into a ground surface while being used by a user in accordance with the disclosed architecture.

FIG. 6 illustrates a perspective view showing one potential embodiment of a footrest device 100 of the present invention screwed into a ground surface 500 while being used by a user 600 in accordance with the disclosed architecture. As shown, a user 600 sitting on a beach chair 606 keeps his or her feet 602, 604 on the top surface 1020 of the foot board 102. The foot board 102 is oriented as per the preferences of the user 600 and is attached to the conical structure 104. Further, the conical structure 104 is screwed into the sand 500 using the corkscrew end 110 as described earlier in the disclosure.

Figure 7:
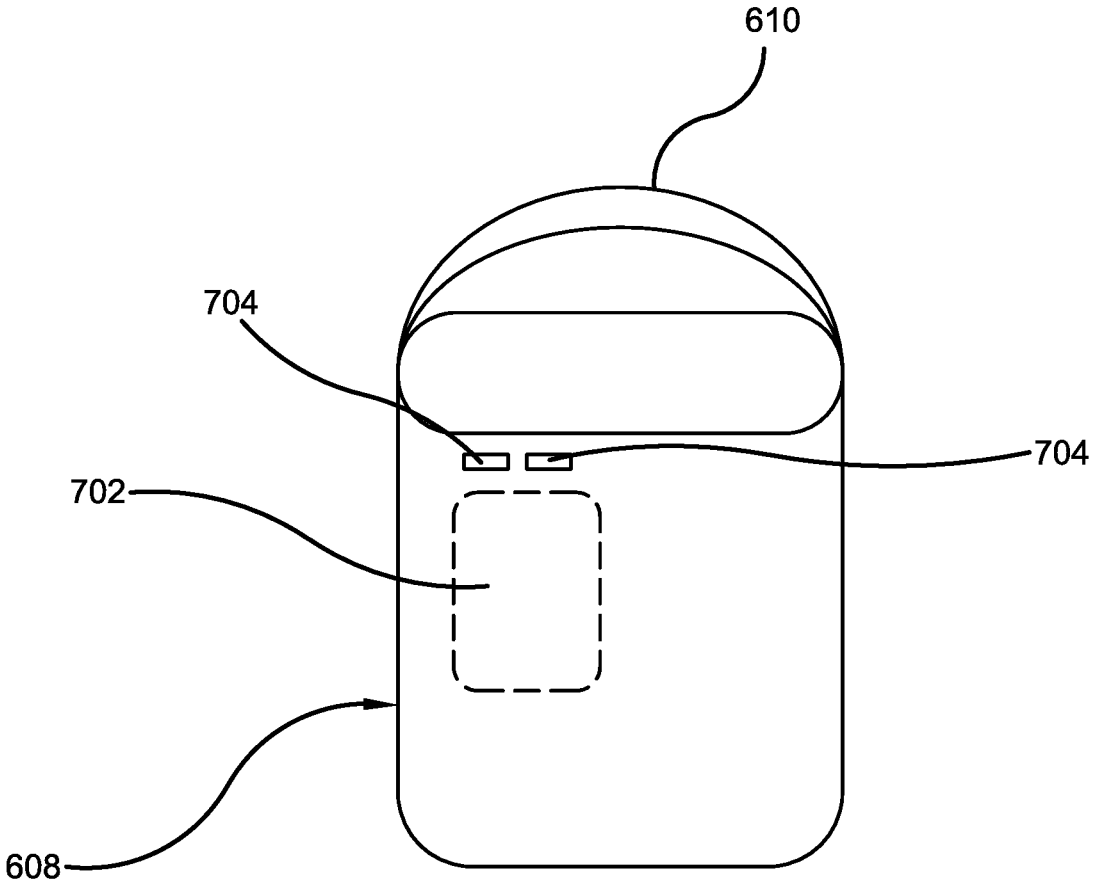
FIG. 7 illustrates one potential embodiment of a footrest device carrying bag of the present invention in accordance with the disclosed architecture.

FIG. 7 illustrates one potential embodiment of a footrest device carrying bag 608 of the present invention in accordance with the disclosed architecture. The device 100 may be comprised of a carrying bag 608 for storing, transporting and protecting the footrest 100, wherein the bag 608 also has a carrying strap 610. The bag 608 also includes an integrated battery 702 and at least one USB port 704 used for charging the battery when the bag 608 is stored at home, and also to charge portable electronic devices when at a campsite or the beach.

Figure 8:
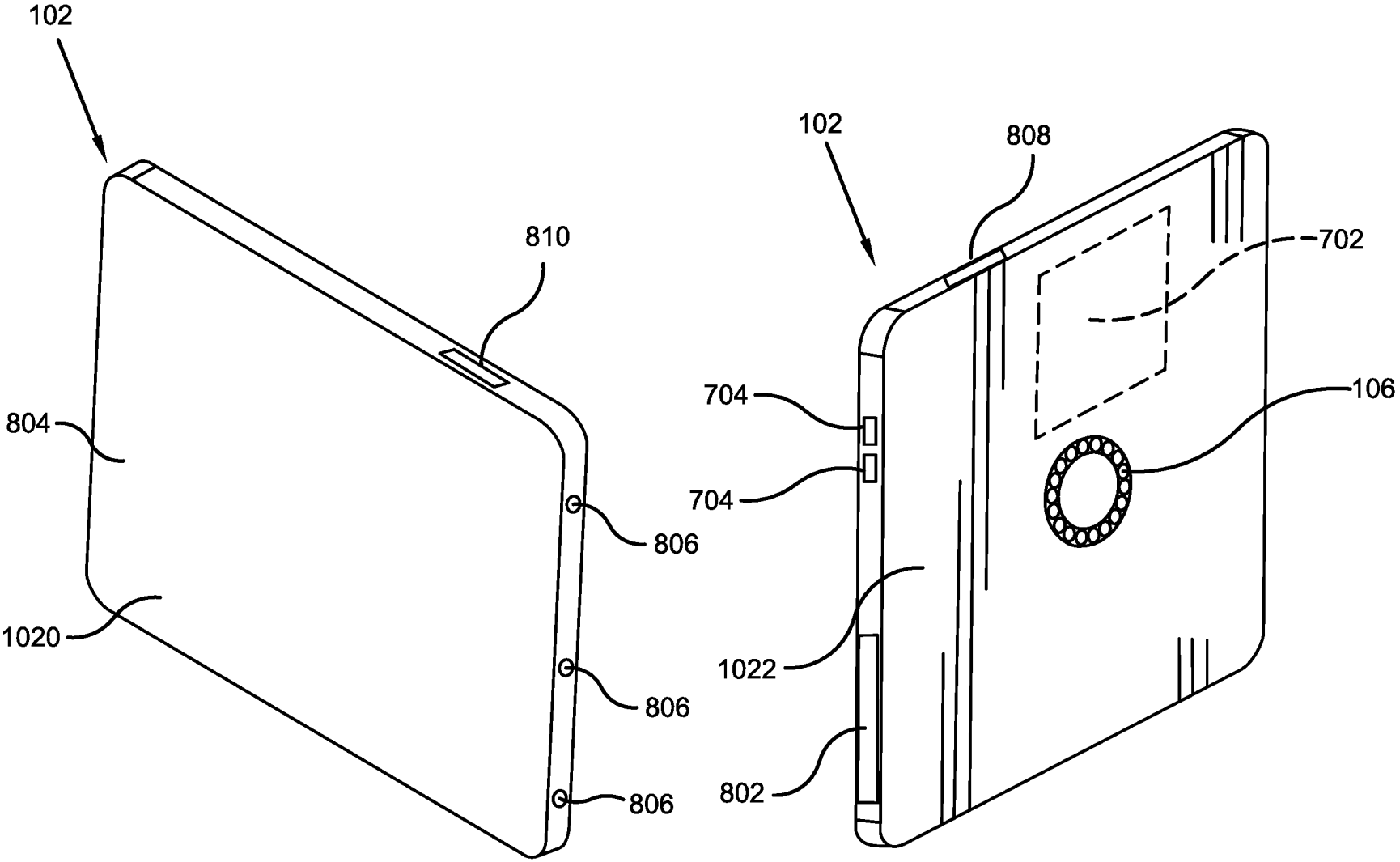
FIG. 8 illustrates one potential embodiment of a footrest device of the present invention in accordance with the disclosed architecture.

FIG. 8 illustrates one potential embodiment of a footrest device 100 of the present invention in accordance with the disclosed architecture. The foot board 102 may include an audio speaker 802 that can be connected to external smart devices through the USB ports 704, or wirelessly through a wireless transceiver 810 such as Bluetooth. An electric heater 804 may be installed in the upper surface 1020 of the foot board 102, wherein the heater 804 may heat the feet 602, 604 of a user. The present invention may also include a plurality of LED lights 806 on the foot board 102 and an ultra-sonic sound generator 808 in the foot board 102 as a means to deter animals and insects from the footrest 100. Further, both the LED lights 806 and generator 808 may be configured to turn on and off remotely through the wireless transceiver 810.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "footrest for campsites and beaches", "footrest device", "footrest", and "device" are interchangeable and refer to the footrest device 100 of the present invention.

Notwithstanding the forgoing, the footrest device 100 of the present invention can be of any suitable size and configuration as is known in the art without affecting the overall concept of the invention, provided that it accomplishes the above-stated objectives. One of ordinary skill in the art will appreciate that the size, configuration, and material of the footrest device 100 as shown in the FIGS. are for illustrative purposes only, and that many other sizes and shapes of the footrest device 100 are well within the scope of the present disclosure. Although the dimensions of the footrest device 100 are important design parameters for user convenience, the footrest device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A footrest device comprising:

a generally rectangular foot board having an upper surface and a lower surface, wherein the upper surface is comprised of an anti-skid gripping texture;

a ball bearing positioned at a center of the lower surface;

a conical shaped structure comprised of a first end and a second end, wherein the first end is comprised of a protruding connector configured to attach to the ball bearing;

a tapered thread distributed from the first end to the second end, wherein the second end is shaped as a cork screw and configured to screw into a ground surface;

wherein the conical shaped structure having a top section forming a base;

wherein the base adjacent the lower surface of the foot board;

wherein the foot board having a front edge and an opposite edge;

wherein when the second end is screwed into the ground surface the front edge is proximal to a user and adjacent to the ground surface and the opposite edge is distal to the user and elevated from the ground surface to provide an inclined angle to the foot board relative to the ground surface; and further wherein the user places their heels near the front edge and their toes near the opposite edge.

2. The footrest device of claim 1, wherein the generally rectangular foot board is removably attachable to the conical shaped structure.

3. The footrest device of claim 2, wherein the generally rectangular foot board comprises a battery and at least one USB port.

4. The footrest device of claim 3, wherein the generally rectangular foot board comprises a built-in wireless transceiver.

5. The footrest device of claim 4, wherein the generally rectangular foot board comprises a remotely accessible heater.

6. The footrest device of claim 4, wherein the generally rectangular foot board comprises a plurality of remotely accessible LED lights and an audio speaker.

7. The footrest device of claim 4, wherein the generally rectangular foot board comprises a remotely accessible ultra-sonic wave generator.

8. The footrest device of claim 1, wherein the footrest device is comprised of at least one of a wood, a plastic, a metal, a rubber and a silicone.

9. A footrest device comprising:

a foot board having an upper surface and a lower surface, wherein the upper surface comprises an anti-skid gripping texture and wherein the lower surface comprises a ball bearing positioned at a center of the lower surface;

a conical structure comprised of a first end and a second end, wherein the first end comprises a protruding connector configured to attach to the ball bearing, a tapered thread distributed from the first end to the second end, and a second end shaped as a cork screw that is configured to screw into a ground surface;

wherein the conical structure having a top section forming a base;

wherein the base adjacent the lower surface of the foot board;

wherein the foot board having a front edge and an opposite edge;

wherein when the second end is screwed into the ground surface the front edge is proximal to a user and adjacent to the ground surface and the opposite edge is distal to the user and elevated from the ground surface to provide an inclined angle to the foot board relative to the ground surface;

wherein the user places their heels near the front edge and their toes near the opposite edge; and a beach chair.

10. The footrest device of claim 9, wherein the foot board and the conical shaped structure are attachable and detachable from one another.

11. The footrest device of claim 10, wherein the foot board further comprises a battery and a at least one USB port.

12. The footrest device of claim 9, wherein the footrest device is comprised of at least one of a wood, a plastic, a metal, a rubber and a silicone.

13. A footrest device comprising:

a foot board having an upper surface and a lower surface, wherein the upper surface is comprised of an anti-skid gripping texture;

a ball bearing positioned at a center of the lower surface;

a conical structure comprised of a first end and a second end, wherein the second end comprised a cork screw that is configured to screw into a ground surface;

a protruding connector configured to attach the conical structure to the ball bearing;

a tapered thread distributed from the first end to the second end of the conical shaped structure;

a carrying bag comprised of a housing having an opening and a strap connected to the housing;

wherein the conical shaped structure having a top section forming a base;

wherein the base adjacent the lower surface of the foot board;

wherein the conical shaped structure having a length from about 6 inches to about 9 inches;

wherein the foot board having a front edge and an opposite edge;

wherein when the second end is screwed into the ground surface the front edge is proximal to a user and proximal to the ground surface and the opposite edge is distal to the user and elevated from the ground surface to provide an inclined angle to the foot board relative to the ground surface; and further wherein the user places their heels near the front edge and their toes near the opposite edge.

14. The footrest device of claim 13, wherein the foot board and the conical shaped structure are attachable and detachable from one another.

15. The footrest device of claim 14, wherein the foot board is further comprised of a battery and at least one USB port.

16. The footrest device of claim 13, wherein the carrying bag is further comprised of a battery and at least one USB port.

17. The footrest device of claim 13, wherein each of the footrest device and the carrying bag are comprised of at least one of a wood, a plastic, a metal, a rubber and a silicone.

* * * * *